US012601532B2

(12) United States Patent
Lazzarini et al.

(10) Patent No.: US 12,601,532 B2
(45) Date of Patent: Apr. 14, 2026

(54) REFRIGERATING APPLIANCE

(71) Applicant: ELECTROLUX APPLIANCES AKTIEBOLAG, Stockholm (SE)

(72) Inventors: Paolo Lazzarini, Porcia (IT); Tommaso Pellegrini, Porcia (IT); Gilberto Pin, Porcia (IT)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 262 days.

(21) Appl. No.: 17/771,963

(22) PCT Filed: Oct. 2, 2020

(86) PCT No.: PCT/EP2020/077695
§ 371 (c)(1),
(2) Date: Apr. 26, 2022

(87) PCT Pub. No.: WO2021/089254
PCT Pub. Date: May 14, 2021

(65) Prior Publication Data

US 2022/0381501 A1 Dec. 1, 2022

(30) Foreign Application Priority Data

Nov. 5, 2019 (EP) ..... 19207120

(51) Int. Cl.
*F25D 11/02* (2006.01)
*F25D 17/06* (2006.01)

(52) U.S. Cl.
CPC ..... *F25D 11/022* (2013.01); *F25D 17/065* (2013.01); *F25D 17/067* (2013.01);
(Continued)

(58) Field of Classification Search
CPC .... F25D 11/022; F25D 17/065; F25D 17/067; F25D 2317/0681; F25D 2317/0682; F25D 2700/122
See application file for complete search history.

(56) References Cited

U.S. PATENT DOCUMENTS 6,438,978 B1 8/2002 Bessler
2002/0134095 A1 9/2002 Temmyo et al.
(Continued)

FOREIGN PATENT DOCUMENTS

CN 1132847 10/1996
EP 1176346 1/2002
(Continued)

OTHER PUBLICATIONS

WO 2014163831 A1 Translation (Year: 2014).*
(Continued)

*Primary Examiner* — Jerry-Daryl Fletcher
*Assistant Examiner* — Dario Antonio Deleon
(74) *Attorney, Agent, or Firm* — Chrisman Gallo Tochtrop LLC

(57) ABSTRACT

A refrigerating appliance is provided. The refrigerating appliance comprises: —a first storage compartment and a second storage compartment, the first and second storage compartments being separated from each other; —a refrigeration circuit comprising a first evaporator associated to the first storage compartment, a second evaporator associated to the second storage compartment, and a compressor for causing refrigerant to flow in the refrigeration circuit through the first evaporator and the second evaporator, the first evaporator, the second evaporator and the compressor being fluidly connected in series; —temperature sensors adapted to sense a first temperature indicative of the temperature inside the first storage compartment and a second
(Continued)

Figure 1:
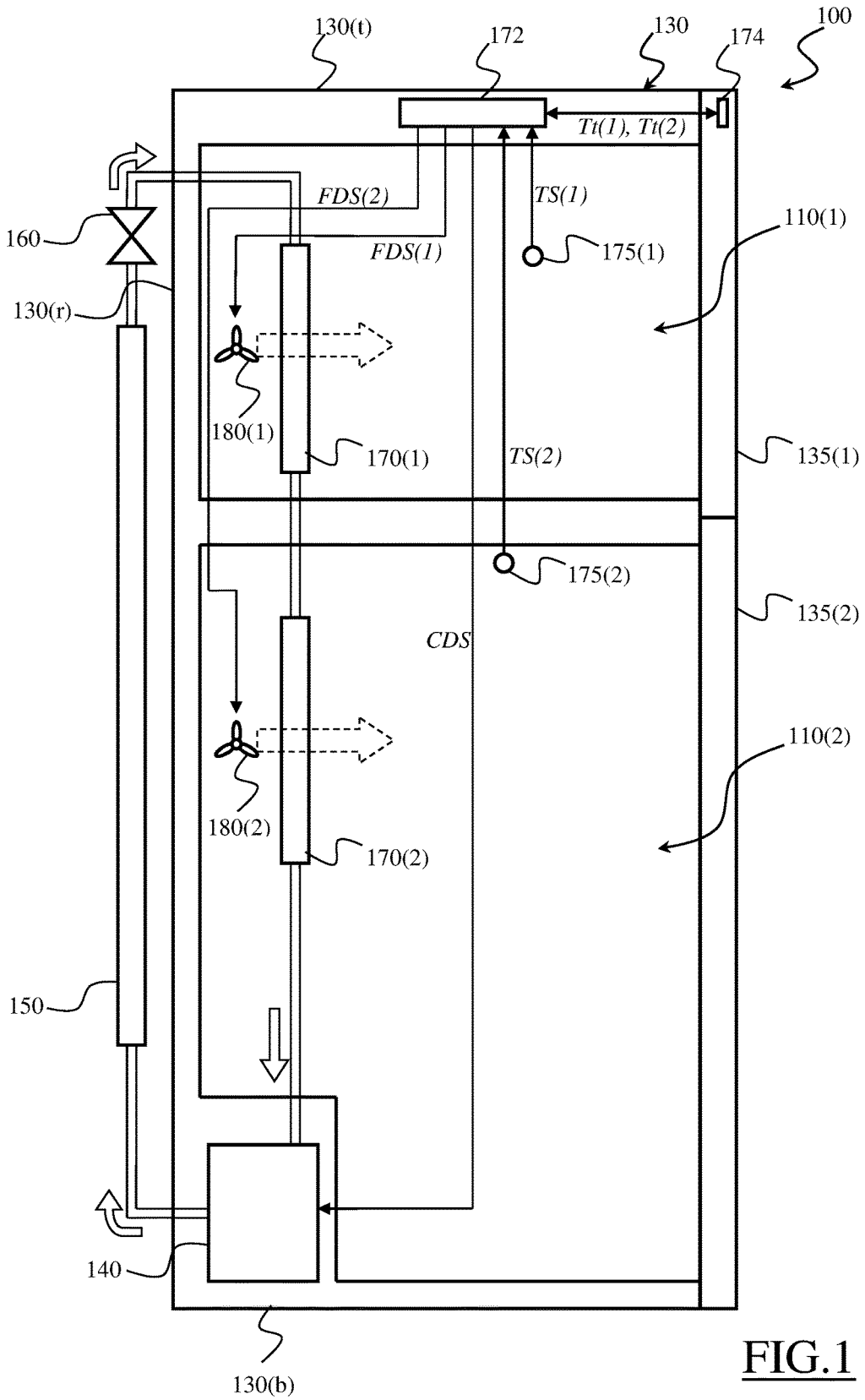

temperature indicative of the temperature inside the second storage compartment; —a control unit configured to set a flow rate of the compressor according to both: —a first difference between the sensed first temperature and a first storage compartment target temperature, and —a second difference between the sensed second temperature and a second storage compartment target temperature.

12 Claims, 3 Drawing Sheets

(52) U.S. Cl.
CPC ..... *F25D 2317/0681* (2013.01); *F25D 2317/0682* (2013.01); *F25D 2700/122* (2013.01)

(56) References Cited

U.S. PATENT DOCUMENTS

| | | | | |
|---|---|---|---|---|
| 2007/0144190 | A1* | 6/2007 | Temmyo et al. | F25B 1/10 62/180 |
| 2008/0314054 | A1 | 12/2008 | An et al. | |
| 2020/0064048 | A1* | 2/2020 | Liengaard et al. | F25D 17/045 |
| 2020/0088462 | A1* | 3/2020 | Ahn et al. | F25D 17/067 |

FOREIGN PATENT DOCUMENTS

| | | | | |
|---|---|---|---|---|
| EP | 1243880 | | 9/2002 | |
| EP | 2015009 | | 1/2009 | |
| JP | 2000146398 | | 5/2000 | |
| JP | 2000146398 | A * | 5/2000 | F25B 2600/021 |
| KR | 19990048384 | | 7/1999 | |
| WO | WO 2012150196 | A1 * | 11/2012 | F25D 29/00 |
| WO | WO 2014163831 | A1 * | 10/2014 | F25D 11/022 |

OTHER PUBLICATIONS

JP 2000146398 A Translation (Year: 2000).*
WO 2012150196 A1 Translation (Year: 2012).*
International Search Report for PCT/EP2020/077695 dated Dec. 9, 2020, 3 pages.
English translation of Chinese Office action for application No. 202080077928.3, dated Apr. 14, 2025, 13 pages.

* cited by examiner

REFRIGERATING APPLIANCE

FIELD OF THE INVENTION

The present invention generally relates to a refrigerating appliance. More particularly, the present invention relates to a refrigerating appliance with an improved temperature control.

BACKGROUND OF THE INVENTION

Conventional refrigerating appliances comprise one or more storage compartments, which allow refrigerating food and beverage articles through a heat pump refrigeration circuit exploiting the evaporation of a refrigerant fluid that flows in one or more evaporators. The refrigeration circuit also comprises, among other elements, a compressor configured to cause the refrigerant fluid to circulate in the refrigeration circuit, and to increase the pressure, and therefore the temperature, of the refrigerant fluid itself.

As it is well known to those skilled in the art, temperature control inside the storage compartments can be obtained by properly control the flow rate of the compressor, for example by adjusting the speed or the duty cycle thereof.

Refrigerating appliances comprising more storage compartments intended to be at reciprocally different temperatures (also referred to as combined refrigerating appliances) are very common. For example, combined refrigerating appliances for domestic use typically comprise two storage compartments, and namely a first, lower-temperature, storage compartment (commonly referred to as freezer compartment) adapted to be at low temperatures (e.g., in the range [−27, −18] ° C.) and a second, higher-temperature, storage compartment (commonly referred to as fresh-food compartment) adapted to be at higher temperatures (e.g., in the range [3, 7] ° C.).

Two main approaches are known for implementing combined refrigerating appliances comprising a lower-temperature storage compartment and a higher-temperature storage compartment.

According to a first approach, the refrigerating circuit is provided with a single evaporator, which is used to refrigerate both the two storage compartments. According to this approach, cold refrigerating air generated at the (single) evaporator is first fed to the lower-temperature storage compartment, where it warms up by thermal exchange with food and beverage articles, and then to the higher-temperature storage compartment.

According to a second approach, the refrigerating circuit is provided with two evaporators, and namely a first evaporator associated to the lower-temperature storage compartment and a second evaporator associated to the higher-temperature storage compartment. According to this approach, the cold refrigerating air generated at an evaporator associated to a storage compartment is (mainly) employed for refrigerating said storage compartment.

Different architectures to implement a refrigeration circuit comprising two evaporators are known in the art.

One architecture provides that the refrigeration circuit has the two evaporators that are fluidly connected in series, whereby the refrigerant fluid firstly flows through a first evaporator and then flows through a second evaporator. Compared to other architectures, a refrigeration circuit in which the evaporators are connected in series is easier to be implemented, requiring less hydraulic system components.

SUMMARY OF INVENTION

The Applicant has realized that the known solutions for implementing combined refrigerating appliances with a refrigeration circuit comprising two evaporators fluidly connected in series to each other and each associated to a different storage compartment are not particularly satisfactory because affected by temperature control drawbacks.

In a refrigeration circuit comprising two evaporators fluidly connected in series to each other and configured to be crossed by the same refrigerant fluid, independently setting and controlling the temperatures in each storage compartment in an efficient way by adjusting the flow rate of the compressor is not an easy task. Indeed, since the same refrigerator fluid flows in both the two evaporators, adjusting the flow rate of the compressor causes a variation in the pressure and temperature of the refrigerant fluid that causes in turn a temperature variation in both the two storage compartments. This may produce undesired undercooling in one of the two storage compartments.

In view of the above, it is an object of the present invention to provide a refrigerating appliance that is not affected by the abovementioned drawbacks.

The Applicant has devised a solution that allows to control in a better and faster way the temperature of each storage compartment, improving the refrigeration efficiency of the refrigeration circuit by managing the compressor of the refrigerant circuit in a way that takes into account the actual temperatures of the storage compartments.

One or more aspects of the present invention are set out in the independent claims, with advantageous features of the same invention that are indicated in the dependent claims.

An aspect of the present invention relates to a refrigerating appliance.

According to an embodiment of the present invention, the refrigerating appliance comprises a first storage compartment and a second storage compartment, the first and second storage compartments being separated from each other.

According to an embodiment of the present invention, the refrigerating appliance comprises a refrigeration circuit comprising a first evaporator associated to the first storage compartment and a second evaporator associated to the second storage compartment.

According to an embodiment of the present invention, the refrigerating appliance comprises a compressor for causing refrigerant to flow in the refrigeration circuit through the first evaporator and the second evaporator.

According to an embodiment of the present invention, the first evaporator, the second evaporator and the compressor are fluidly connected in series.

According to an embodiment of the present invention, the refrigerating appliance comprises temperature sensors adapted to sense a first temperature indicative of the temperature inside the first storage compartment and a second temperature indicative of the temperature inside the second storage compartment.

According to an embodiment of the present invention, the refrigerating appliance comprises a control unit configured to set a flow rate of the compressor according to both:

- a first difference between the sensed first temperature and a first storage compartment target temperature, and
- a second difference between the sensed second temperature and a second storage compartment target temperature.

According to an embodiment of the present invention, the control unit is configured to set the flow rate of the compressor according to an average of said first difference and said second difference.

According to an embodiment of the present invention, the control unit is configured to set the flow rate of the compressor according to an arithmetic mean of said first difference and said second difference.

According to an embodiment of the present invention, the control unit is configured to set the flow rate of the compressor according to a weighted average of said first difference and said second difference.

According to an embodiment of the present invention, said first difference has a lower weight compared to a weight of said second difference in said weighted average.

According to an embodiment of the present invention, said first difference has a higher weight compared to a weight of said second difference in said weighted average.

According to an embodiment of the present invention, at least one evaporator between the first evaporator and the second evaporator is associated with a corresponding fan configured to promote heat exchange between said at least one evaporator and the storage compartment associated to said at least one evaporator.

According to an embodiment of the present invention, the control unit is configured to set a flow rate of said fan according to a difference between:

said sensed temperature of the storage compartment associated with the evaporator which is in turn associated with said fan, and said target temperature of said storage compartment associated with the evaporator which is in turn associated with said fan.

In this way, the rotation speed of the fan, and therefore the thermal exchange degree between the evaporator associated to said fan and the volume of air inside the storage compartment associated with the evaporator, is advantageously set by taking into consideration the actual temperature of said storage compartment, and particularly, its drift with respect to the storage compartment target temperature.

According to an embodiment of the present invention the first evaporator is associated with a corresponding first fan configured to promote heat exchange between said first evaporator and the first storage compartment.

According to an embodiment of the present invention, the second evaporator is associated with a corresponding second fan configured to promote heat exchange between said second evaporator and the second storage compartment.

According to an embodiment of the present invention, the control unit is configured to set a flow rate of said first fan according to said first difference.

According to an embodiment of the present invention, the control unit is configured to set a flow rate of said second fan according to said second difference.

In this way, occurrences of undercooling are reduced because the flow rate of the compressor is advantageously set to compensate a global temperature drift relating both to the temperature drift in the first storage compartment and to the temperature drift in the second storage compartment, while the flow rate of the first fan is advantageously set to compensate a first local temperature drift relating to the temperature drift in the first storage compartment, and the flow rate of the second fan is advantageously set to compensate a second local temperature drift relating to the temperature drift in the second storage compartment.

According to an embodiment of the present invention, the control unit is configured to:

when the average of said first difference and said second difference is higher than zero, increase the flow rate of the compressor, and when the average of said first difference and said second difference is lower than zero, decrease the flow rate of the compressor.

According to an embodiment of the present invention, the control unit is configured to:

when the first difference is higher than zero, increase the flow rate of the first fan;

when the first difference is lower than zero, decrease the flow rate of the first fan, and/or:

when the second difference is higher than zero, increase the flow rate of the second fan, and when the second difference is lower than zero, decrease the flow rate of the second fan.

According to an embodiment of the present invention, the first evaporator is associated with a corresponding first fan configured to promote heat exchange between said first evaporator and the first storage compartment, and no fan is associated with the second evaporator.

According to an embodiment of the present invention, the control unit is configured to set the flow rate of the compressor according to a weighted average of said first difference and said second difference, with said first difference that has a lower weight compared to a weight of said second difference.

In this way, occurrences of undercooling are reduced even with a single fan, since the temperature variation caused by the variation of the flow rate of the compressor is advantageously calibrated to have a higher effect in the storage compartment that does not have any fan compared to the other storage compartment having the fan.

According to an embodiment of the present invention, the control unit is configured to set a flow rate of said first fan according to said first difference.

According to an embodiment of the present invention, the control unit is configured to:

when the weighted average of said first difference and said second difference is higher than zero, increase the flow rate of the compressor, and when the weighted average of said first difference and said second difference is lower than zero, decrease the flow rate of the compressor.

According to an embodiment of the present invention, the control unit is configured to:

when the first difference is higher than zero, increase the flow rate of the first fan;

when the first difference is lower than zero, decrease the flow rate of the first fan.

According to an embodiment of the present invention, the refrigeration circuit is arranged to have the first evaporator upstream the second evaporator along a flow direction of the refrigerant in said refrigeration circuit.

According to an embodiment of the present invention, the refrigeration circuit further comprises at least one condenser.

According to an embodiment of the present invention, the first storage compartment is a freezer storage compartment, and the second storage compartment is a fresh food storage compartment.

According to an embodiment of the present invention, the compressor is a variable speed compressor, the control unit being configured to set the flow rate of the compressor by setting the speed of the compressor.

According to an embodiment of the present invention, the control unit is configured to set the flow rate of the compressor by setting the duty cycle of the compressor.

According to an embodiment of the present invention, the control unit is configured to set the flow rate of the first and/or second fan by setting the rotation speed of the first and/or second fan.

According to an embodiment of the present invention, the control unit is configured to set the flow rate of the first and/or second fan by setting the duty cycle of the first and/or second fan. Another aspect of the present invention relates to a method for operating a refrigerating appliance.

According to an embodiment of the present invention, the refrigerating appliance comprises a first storage compartment and a second storage compartment, the first and second storage compartments being separated from each other.

According to an embodiment of the present invention, the refrigerating appliance comprises a refrigeration circuit comprising a first evaporator associated to the first storage compartment, a second evaporator associated to the second storage compartment, and a compressor for causing refrigerant to flow in the refrigeration circuit through the first evaporator and the second evaporator, the first evaporator, the second evaporator and the compressor being fluidly connected in series.

According to an embodiment of the present invention, the method comprises sensing a first temperature indicative of the temperature inside the first storage compartment and a second temperature indicative of the temperature inside the second storage compartment.

According to an embodiment of the present invention, the method comprises setting a flow rate of the compressor according to both:

- a first difference between the sensed first temperature and a first storage compartment target temperature, and
- a second difference between the sensed second temperature and a second storage compartment target temperature.

According to an embodiment of the present invention, the method comprises setting the flow rate of the compressor according to an average of said first difference and said second difference.

According to an embodiment of the present invention, the method comprises setting the flow rate of the compressor according to an arithmetic mean of said first difference and said second difference.

According to an embodiment of the present invention, the method comprises setting the flow rate of the compressor according to a weighted average of said first difference and said second difference.

According to an embodiment of the present invention, said first difference has a lower weight compared to a weight of said second difference in said weighted average.

According to an embodiment of the present invention, said first difference has a higher weight compared to a weight of said second difference in said weighted average.

According to an embodiment of the present invention, at least one evaporator between the first evaporator and the second evaporator is associated with a corresponding fan configured to promote heat exchange between said at least one evaporator and the storage compartment associated to said at least one evaporator, the method comprising setting a flow rate of said fan according to a difference between:

- said sensed temperature of the storage compartment associated with the evaporator which is in turn associated with said fan, and
- said target temperature of said storage compartment associated with the evaporator which is in turn associated with said fan.

BRIEF DESCRIPTION OF THE ANNEXED DRAWINGS

Figure 2:
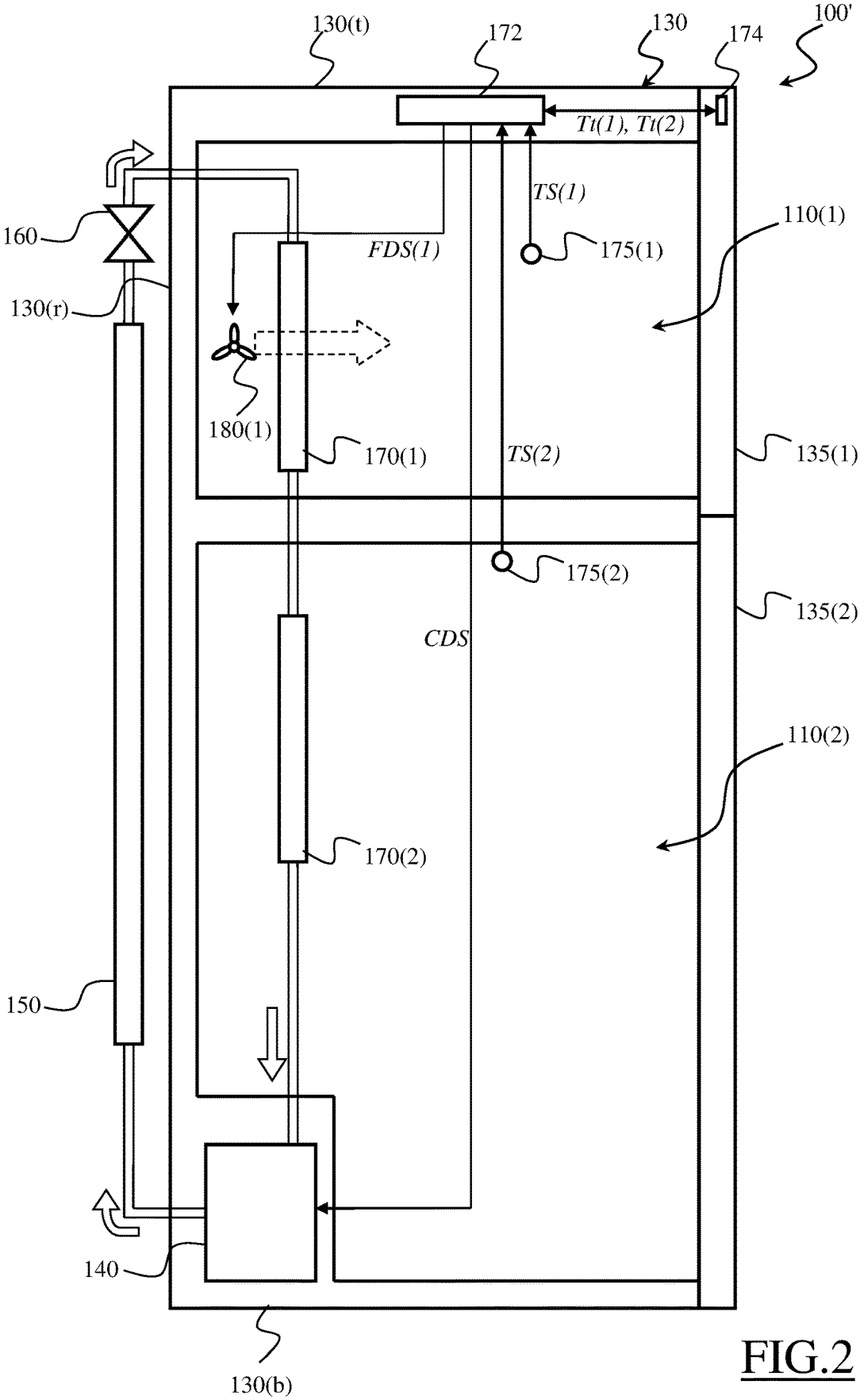
Figure 3:
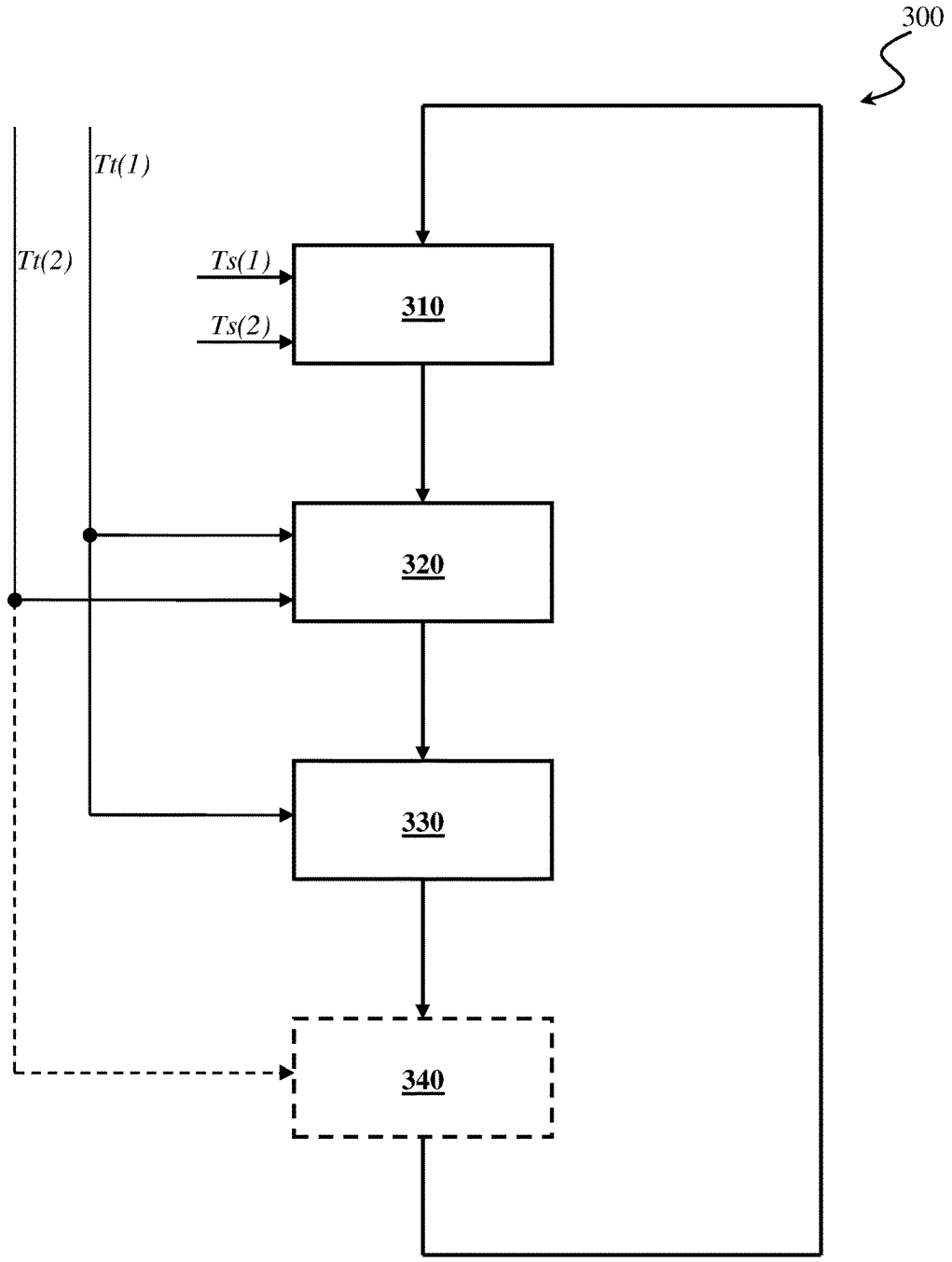

These and other features and advantages of the present invention will be made apparent by the following description of some exemplary and non-limitative embodiments thereof; for its better intelligibility, the following description should be read making reference to the attached drawings, wherein:

FIG. 1 schematically illustrates a refrigerating appliance according to a first embodiment of the invention;

FIG. 2 schematically illustrates a refrigerating appliance according to a second embodiment of the invention, and FIG. 3 is a flow chart of operations carried out by a control unit of the refrigerating appliance of FIG. 1 or FIG. 2 according to an embodiment of the present invention.

DETAILED DESCRIPTION OF PREFERRED EMBODIMENTS OF THE INVENTION

With reference to the drawings, FIG. 1 schematically illustrates a (not-in-scale) cross-sectional side view of a refrigerating appliance 100 according to a first embodiment of the invention.

The refrigerating appliance 100 comprises a number of well known electronic, mechanical and/or electro-mechanical components—however, for the sake of description ease and conciseness, only those being relevant for understanding the invention will be introduced and discussed in the following.

According to an embodiment of the present invention, the refrigerating appliance 100 is a combined-type refrigerating appliance, comprising a first storage compartment 110(1) and a second storage compartment 110(2) where food and beverage articles can be stored and preserved by refrigeration at different temperatures.

In the considered example, the first storage compartment 110(1) is a storage compartment adapted to operate at lower temperature than the second storage compartment 110(2).

For example, the first storage compartment 110(1) is a lower-temperature storage compartment, such as a freezer compartment, adapted to be at temperatures below 0° C. (e.g., in the range [−27, −18] ° C.). The second storage compartment 110(2) is a higher-temperature storage compartment, such as a fresh-food compartment, adapted to be at temperatures above 0° C. (e.g., in the range [3, 7] ° C.). These temperature ranges have to be intended only as non limitative examples, since the concepts of the present invention can be directly applied to any range of temperatures, and also if the first and second storage compartments 110(1), 110(2) are both adapted to operate at temperatures below 0° C. or are both adapted to operate at temperatures above 0° C., provided that the first storage compartment 110(1) is adapted to operate at different, preferably lower, temperatures than the second storage compartment 110(2).

In the illustrated example, the first storage compartment 110(1) is positioned above the second storage compartment 110(2), however similar considerations apply in case the positions of the two compartments 110(1), 110(2) are swapped.

Shelves and other structures for supporting and storing food and beverage articles (not illustrated in the figures) may be provided within both the first and second storage compartments 110(1), 110(2).

According to an embodiment of the present invention, the refrigerating appliance 100 comprises a substantially parallepiped-shaped cabinet 130, having a top panel **130(*t*), a rear panel 130(*r*), a bottom panel 130(*b*) and side panels (not visible). Naturally, similar considerations apply in case the cabinet 130** has a different shape and/or structure.

According to a preferred embodiment of the present invention, a first door 135(1) and a second door 135(2) are hingedly mounted to a front portion of the cabinet 130 to provide selective access to the first storage compartment 110(1) and to the second storage compartment 110(2), respectively.

According to an embodiment of the present invention, the refrigerating appliance 100 is equipped with a refrigeration circuit for circulating a refrigeration fluid (briefly referred to as "refrigerant").

According to an embodiment of the present invention, the refrigeration circuit comprises a compressor unit 140, a condenser unit 150, a fluid expansion unit 160, a first evaporator unit 170(1) associated to the first storage compartment 110(1), and a second evaporator unit 170(2) associated to the second storage compartment 110(2).

According to an embodiment of the present invention, the two evaporator units 170(1) and 170(2) are fluidly connected in series to each other in the refrigeration circuit, with the first evaporator unit 170(1) that is upstream the second evaporator unit 170(2) along the flow direction of the refrigerant in said refrigeration circuit (illustrated in the figures through bold arrows).

As it is well known to those skilled in the art, the compressor unit 140 carries out the double function of compressing the refrigerant and causing the circulation of refrigerant itself in the refrigeration circuit—so that the refrigerant flows, in sequence, through the condenser unit 150, the fluid expansion unit 160, the first evaporator unit 170(1), and the second evaporator unit 170(2), before reaching again the compressor unit 140.

According to a preferred embodiment of the present invention, the compressor unit 140 is located on a bottom portion of the refrigerating appliance 100, preferably close to the rear panel 130(*r*) of the casing 130.

According to a preferred embodiment of the present invention, the condenser unit 150 is provided on the rear portion of the refrigerating appliance 100, such as at the rear panel 130(*r*) of the cabinet 130.

According to an embodiment of the present invention, the first evaporator unit 170(1) is located at the first storage compartment 110(1), for example close to the rear panel 130(*r*), and the second evaporator unit 170(2) is located at the second storage compartment 110(2), for example close to the rear panel 130(*r*).

Naturally, the concepts of the present invention can be directly applied in case one or more among the compressor unit 140, the condenser unit 150, the fluid expansion unit 160, the first evaporator unit 170(1), and the second evaporator unit 170(2) are located in different positions of the refrigerating appliance 100, provided that the first evaporator unit 170(1) is arranged in such a way to be able of generating refrigerating air in the first storage compartment 110(1) and the second evaporator unit 170(2) is arranged in such a way to be able of generating refrigerating air in the second storage compartment 110(2).

The compressor unit 140 has an input port fluidly coupled with an output port of the second evaporator unit 170(2) for receiving refrigerant—in the vapor phase—at a relatively low temperature and at a relatively low pressure.

The compressor unit 140 has an output port fluidly coupled with an input port of the condenser unit 150.

The compressor unit 140 is configured to compress the refrigerant received by the second evaporator unit 170(2) so as to increase the pressure and temperature thereof, and to provide the compressed refrigerant to the condenser unit 150.

The compressed refrigerant, still in the vapor phase, flows through the condenser unit 150, wherein it condenses to liquid phase by heat exchange with ambient air.

The condenser unit 150 has an output port fluidly coupled with the fluid expansion unit 160 for providing the refrigerant, now in form of a high pressure liquid, to the latter unit.

The fluid expansion unit 160, for example an expansion valve or a capillary tube, is configured to reduce the pressure, and the temperature, of the refrigerant.

The refrigerant outputted by the fluid expansion unit 160—which is a low pressure, low temperature fluid in which liquid and vapor phase coexist—is fed to an input port of the first evaporator unit 170(1).

As the refrigerant flows through the first evaporator unit 170(1), part of the liquid fraction of the refrigerant turns from liquid into vapor through evaporation, causing air inside the first storage compartment 110(1) to cool down.

The refrigerant exits the first evaporator unit 170(1) through an output port thereof, that is fluidly coupled with an input port of the second evaporator unit 170(2).

As the refrigerant flows through the second evaporator unit 170(2), the remaining liquid fraction of the refrigerant turns from liquid into vapor through evaporation, causing air inside the second storage compartment 110(2) to cool down. Once the liquid fraction of the refrigerant is entirely turned into vapor, the temperature of the refrigerant starts to rise up.

According to an embodiment of the present invention, the first evaporator unit 170(1) is larger than the second evaporator unit 170(2), so that the temperature in the first storage compartment 110(1) is lower than the temperature in the second storage compartment 110(2).

The refrigerant—now in vapor phase—outputted from the output port of the second evaporator unit 170(2) is then fed again to the compressor unit 140.

According to an embodiment of the present invention, the compressor unit 140 is capable of setting the volume of refrigerant delivered per time unit (also referred to as "flow rate" or "throughput") under the control of a control unit 172 of the refrigerating appliance 100. For example, the control unit 172 may be configured to generate and send to the compressor a compressor driving signal CDS indicative of a desired flow rate.

As it is well known to those skilled in the art:

- if the flow rate of the compressor unit 140 is increased, the cooling effect of the first and second evaporator units 170(1), 170(2) is increased, causing a reduction of the temperatures of the corresponding storage compartments 110(1), 110(2) if other operative parameters are held constant;
- if the flow rate of the compressor unit 140 is decreased, the cooling effect of the first and second evaporator units 170(1), 170(2) is reduced, causing an increasing of the temperatures of the corresponding storage compartments 110(1), 110(2) if other operative parameters are held constant.

According to an embodiment of the present invention, the control unit 172 is configured to set the flow rate of the compressor unit 140 by setting the speed thereof, for example to a value proportional to the compressor driving signal CDS.

According to an embodiment of the present invention, the control unit 172 is configured to set the flow rate of the compressor unit 140 by setting the duty cycle thereof, for example to a value proportional to the compressor driving signal CDS.

As it is well known to those skilled in the art, the higher the speed or the duty cycle of the compressor unit 140, the higher the flow rate. Conversely, the lower the speed or the duty cycle of the compressor unit 140, the lower the flow rate.

According to an embodiment of the present invention, the refrigerating appliance 100 comprises a user interface 174 through which a user may input commands to the control unit 172. For example, as will be described in detail in the following of the present description, the user interface 174 can be advantageously exploited for setting a desired temperature for the first storage compartment 110(1), hereinafter referred to as first target temperature Tt(1), and a desired temperature for the second storage compartment 110(2), hereinafter referred to as second target temperature Tt(2).

Different kind of user interfaces 174 can be provided, from simple rotary knobs inside the storage compartments, to more advanced user interfaces provided with touch screen, buttons, and/or visual display located on one or more of the doors and/or on cabinet. Still more advanced user interfaces 174 can be considered, comprising a wireless communication unit adapted to receive commands and provide data from/to a personal user device, such as a smartphone.

According to an embodiment of the present invention, temperature sensors are provided in both the first storage compartment 110(1) and the second storage compartment 110(2) for sensing the temperature thereinside.

Particularly, according to a preferred embodiment of the present invention, a first temperature sensor 175(1) is located inside the first storage compartment 110(1) and a second temperature sensor 175(2) is located inside the second storage compartment 110(2).

According to a preferred embodiment of the present invention, the first and second temperature sensors 175(1), 175(2) are connected to the control unit 172, to provide the sensed temperatures to the latter. The first temperature sensor 175(1) is configured to provide a first sensed temperature Ts(1) value indicative of the temperature inside the first storage compartment 110(1) to the control unit 172, and the second temperature sensor 175(2) is configured to provide a second sensed temperature Ts(2) value indicative of the temperature inside the second storage compartment 110(2) to the control unit 172.

According to an embodiment of the present invention, the control unit 172 is configured to set a flow rate of the compressor unit 140 according to both:

- a first difference D(1)=Ts(1)−Tt(1) between the first sensed temperature Ts(1) and the first target temperature Tt(1), and
- a second difference D(2)=Ts(2)−Tt(2) between the second sensed temperature Ts(2) and the second target temperature Tt(2).

In other words, according to embodiments of the present invention, the flow rate of the compressor unit 140, and therefore the cooling effect of the first and second evaporator units 170(1), 170(2), is set by taking into considerations the actual temperatures of both the first and second storage compartments 110(1), 110(2).

According to these embodiments of the invention, the flow rate of the compressor unit 140 is set to a value that is a tradeoff between a value capable of compensating for drifts between the actual temperature in the first storage compartment 110(1) and the first target temperature Tt(1), and at the same time capable of compensating for drifts between the actual temperature in the second storage compartment 110(2) and the first target temperature Tt(2).

According to a preferred embodiment of the present invention, the control unit 172 is configured to set a flow rate of the compressor unit 140 according to an average A of the first difference D(1)=Ts(1)−Tt(1) and the second difference D(2)=Ts(2)−Tt(2).

For example, according to an embodiment of the present invention, the control unit 172 is configured to set a flow rate of the compressor unit 140 to a selected value in an allowable flow rate range—spanning from a minimum flow rate value FRmin to a maximum flow rate value FRmax—based on the value of such average A. For example, negative values of the average A may correspond to low flow rate values, closer to the minimum flow rate value FRmin, while positive values of the average A may correspond to high flow rate values, closer to the maximum flow rate value FRmax.

According to the preferable embodiment of the invention illustrated in FIG. 1, the first and second evaporator units 170(1), 170(2) are each one associated with a corresponding fan configured to promote heat exchange between the evaporator itself and the storage compartment associated to the evaporator.

According to a preferred embodiment of the present invention, the refrigerating appliance 100 comprises a first fan 180(1) associated to the first evaporator unit 170(1). Preferably, the first fan 180(1) is configured to promote heat exchange between the evaporator unit 170(1) and the first storage compartment 110(1). For example, the first fan 180(1) may be provided at the first storage compartment 110(1), such as for example between the evaporator unit 170(1) and a portion of the first storage compartment 110(1) close to the rear panel 130(*r*).

According to a preferred embodiment of the present invention, the refrigerating appliance 100 comprises a second fan 180(2) associated to the second evaporator unit 170(2). Preferably, the second fan 180(2) is configured to promote heat exchange between the evaporator unit 170(2) and the second storage compartment 110(2). For example, the second fan 180(2) may be provided at the second storage compartment 110(2), such as for example between the evaporator unit 170(2) and a portion of the second storage compartment 110(2) close to the rear panel 130(*r*).

According to a preferred embodiment of the present invention, the control unit 172 is configured to set the volume of air moved per time unit ("flow rate") of the first fan 180(1). For example, the control unit 172 may be configured to generate and send to the first fan 180(1) a first fan driving signal FDS(1) indicative of a desired flow rate of the first fan 180(1).

According to a preferred embodiment of the present invention, the control unit 172 is configured to set the volume of air moved per time unit ("flow rate") of the second fan 180(2). For example, the control unit 172 may be configured to generate and send to the second fan 180(2) a second fan driving signal FDS(2) indicative of a desired flow rate of the second fan 180(2).

According to an embodiment of the present invention, the control unit 172 is configured to set the flow rate of the first fan 180(1) by setting the rotation speed thereof, for example to a value proportional to the first fan driving signal FDS(1). According to an embodiment of the present invention, the control unit 172 is configured to set the flow rate of the first fan 180(1) by setting the duty cycle thereof, for example to a value proportional to the first fan driving signal FDS(1).

Similarly, according to an embodiment of the present invention, the control unit 172 is configured to set the flow rate of the second fan 180(2) by setting the rotation speed thereof, for example to a value proportional to the second fan driving signal FDS(2). According to an embodiment of the present invention, the control unit 172 is configured to set the flow rate of the second fan 180(2) by setting the duty cycle thereof, for example to a value proportional to the second fan driving signal FDS(2).

As it is well known to those skilled in the art:

- if the flow rate of the first fan 180(1) is increased, the thermal exchange between the first evaporator 170(1) and the volume of air inside the first storage compartment 110(1) is improved, and therefore, if other operative parameters are held constant, the temperature inside the first storage compartment 110(1) is decreased;
- if the flow rate of the first fan 180(1) is decreased, the heat exchange between the first evaporator 170(1) and the volume of air inside the first storage compartment 110(1) is reduced, and therefore, if other operative parameters are held constant, the temperature inside the first storage compartment 110(1) is increased;
- if the flow rate of the second fan 180(2) is increased, the heat exchange between the second evaporator 170(2) and the volume of air inside the second storage compartment 110(2) is improved, and therefore, if other operative parameters are held constant, the temperature inside the second storage compartment 110(2) is decreased;
- if the flow rate of the second fan 180(2) is decreased, the heat exchange between the second evaporator 170(2) and the volume of air inside the second storage compartment 110(2) is reduced, and therefore, if other operative parameters are held constant, the temperature inside the second storage compartment 110(2) is increased.

According to a preferred embodiment of the present invention, the control unit 172 is configured to set the flow rate of the first fan 180(1) to a value proportional to the first fan driving signal FDS(1).

According to a preferred embodiment of the present invention, the control unit 172 is configured to set the flow rate of the second fan 180(2) to a value proportional to the second fan driving signal FDS(2).

According to a preferred embodiment of the present invention, the control unit 172 is configured to set the flow rate of the compressor unit 140 according to an average A of the first difference D(1)=Ts(1)−Tt(1) (between the first sensed temperature Ts(1) and the first target temperature Tt(1)) and the second difference D(2)=Ts(2)−Tt(2) (between the second sensed temperature Ts(2) and the second target temperature Tt(2)), with said average A that corresponds to the arithmetic mean of D(1) and D(2). For example, A may be equal to (D(1)+D(2))/2.

According to a preferred embodiment of the present invention, the control unit 172 is configured to set the flow rate of the first fan 180(1) according to the first difference D(1), i.e., according to the difference between the first sensed temperature Ts(1) and the first target temperature Tt(1).

According to a preferred embodiment of the present invention, the control unit 172 is configured to set the flow rate of the second fan 180(2) according to the second difference D(2), i.e., according to the difference between the second sensed temperature Ts(2) and the second target temperature Tt(2).

In other words, according to embodiments of the present invention, the flow rate of the first fan 180(1), and therefore the heat exchange degree between the first evaporator 170(1) and the volume of air inside the first storage compartment 110(1), is set by taking into consideration the actual temperature of the first storage compartment 110(1) (and particularly, its drift with respect to the first target temperature Tt(1)) Similarly, the flow rate of the second fan 180(2), and therefore the heat exchange degree between the second evaporator 170(2) and the volume of air inside the second storage compartment 110(2), is set by taking into consideration the actual temperature of the second storage compartment 110(2) (and particularly, its drift with respect to the second target temperature Tt(2)).

According to a preferred embodiment of the present invention, the control unit 172 is configured to set the flow rate of the first fan 180(1) to a selected value in an allowable first fan flow rate range—spanning from a minimum first fan flow rate FS(1)min to a maximum first fan flow rate FS(1)max—based on the value of the first difference D(1)=Ts(1)−Tt(1) between the first sensed temperature Ts(1) and the first target temperature Tt(1). For example, negative values of the first difference D(1) may correspond to low first fan flow rate values, closer to the minimum first fan flow rate FS(1)min, while positive values of the first difference D(1) may correspond to high first fan flow rate values, closer to the maximum first fan flow rate FS(1)max.

According to a preferred embodiment of the present invention, the control unit 172 is configured to set the flow rate of the second fan 180(2) to a selected value in an allowable second fan flow rate range—spanning from a minimum second fan flow rate FS(2)min to a maximum second fan flow rate FS(2)max—based on the value of the second difference D(2)=Ts(2)−Tt(2) between the second sensed temperature Ts(2) and the second target temperature Tt(2). For example, negative values of the second difference D(2) may correspond to low second fan flow rate values, closer to the minimum second fan flow rate FS(2)min, while positive values of the second difference D(2) may correspond to high second fan flow rate values, closer to the maximum second fan flow rate FS(2)max.

According to this embodiment of the invention, while the flow rate of the compressor unit 140 is set to compensate a "global temperature drift" relating both to the temperature drift in the first storage compartment 110(1) (with respect to the first target temperature Tt(1)) and to the temperature drift in the second storage compartment 110(2) (with respect to the second target temperature Tt(2)), the flow rate of the first fan 180(1) is set to compensate a "first local temperature drift" relating to the temperature drift in the first storage compartment 110(1) (with respect to the first target temperature Tt(1)), and the flow rate of the second fan 180(2) is set to compensate a "second local temperature drift" relating to the temperature drift in the second storage compartment 110(2) (with respect to the second target temperature Tt(2)).

The temperature control according to this embodiment of the invention is a two-tier temperature control, with a first tier corresponding to the temperature control obtained by controlling the flow rate of the compressor unit 140, and a second tier corresponding to the temperature control obtained by controlling the rotation speed of the first and second fans 180(1), 180(2).

This peculiar control scheme advantageously avoids situations in which one of the storage compartment is subjected to undercooling when its actual temperature is close to its respective target temperature (and therefore it does need to be adjusted), while the other storage compartment has its temperature that is sensibly higher than its respective target temperature (and therefore it has to be sensibly decreased). In this case, the flow rate of the compressor unit 140 is increased since the average A is higher than zero (causing thus a global reduction in the temperatures of both the storage compartment), but the flow rate of the fan associated to the storage compartment that does not require change in temperature is advantageously reduced to counterbalance the undesired (and unnecessary) temperature reduction caused by the flow rate increasing of the compressor.

According to a preferred embodiment of the present invention, the control unit 172 is configured to increase the flow rate of the compressor unit 140 when the average A of the first difference D(1)=Ts(1)−Tt(1) and the second difference D(2)=Ts(2)−Tt(2) is higher than zero.

According to a preferred embodiment of the present invention, the control unit 172 is configured to decrease the flow rate of the compressor unit 140 when the average A of the first difference D(1)=Ts(1)−Tt(1) and the second difference D(2)=Ts(2)−Tt(2) is lower than zero.

According to a preferred embodiment of the present invention, the control unit 172 is configured to increase the rotation speed of the first fan 180(1) when the first difference D(1)=Ts(1)−Tt(1) is higher than zero.

According to a preferred embodiment of the present invention, the control unit 172 is configured to decrease the flow rate of the first fan 180(1) when the first difference D(1)=Ts(1)−Tt(1) is lower than zero.

According to a preferred embodiment of the present invention, the control unit 172 is configured to increase the flow rate of the second fan 180(2) when the second difference D(2)=Ts(2)−Tt(2) is higher than zero.

According a preferred an embodiment of the present invention, the control unit 172 is configured to decrease the flow rate of the second fan 180(2) when the second difference D(2)=Ts(2)−Tt(2) is lower than zero.

The embodiments of the invention described above make reference to the case illustrated in FIG. 1, wherein each evaporator unit 170(1), 170(2) is associated with a respective fan 180(1), 180(2), respectively.

However, the concepts of the present invention can be also applied to cases in which only one evaporator unit is associated with a respective fan, while the other one is not provided with any fan.

Making for example reference to the refrigerating appliance 100' illustrated in FIG. 2 (in which elements corresponding to the ones illustrated in FIG. 1 are identified with the same references), only the first evaporator unit 170(1) is associated with a corresponding fan 180(1).

In this case as well, the control unit 172 may be preferably configured to set a flow rate of the compressor unit 140 according to an average A of the first difference D(1)=Ts(1)−Tt(1) and the second difference D(2)=Ts(2)−Tt(2). Moreover, the control unit 172 is configured to set the flow rate of the first fan 180(1) according to the first difference D(1)=Ts(1)−Tt(1).

According to a preferred embodiment of the present invention, the average A of the first difference D(1) and the second difference D(2) is a weighted average A of the first difference D(1) and the second difference D(2), with said first difference D(1) that has a lower weight W(1) compared to a weight W(2) of the second difference D(2). For example, A may be equal to a weighted arithmetic mean of D(1) and D(2), i.e., (W(1)D(1)+W(2)D(2))/(W(1)+W(2)), wherein the weight W(1) of D(1) is lower than the weight W(2) of D(2).

In this way, the temperature variation caused by the variation of the flow rate of the compressor unit 140 is advantageosuly calibrated to have a higher effect in the storage compartment having the evaporator unit not associated with any fan (i.e., the second storage compartment 110(2)) compared to the other storage compartment having the evaporator unit that is associated with the fan (i.e., the first storage compartment 110(1)), reducing thus occurrences of undercooling of the storage compartment without fan; in other words, the compressor flow rate is set closer to the temperature requirement of the storage compartment having the evaporator unit not associated with any fan (i.e., the second storage compartment 110(1)), whereas the temperature requirement of the storage compartment having the evaporator unit that is associated with the fan (i.e., the first storage compartment 110(2)) can be adjusted through the fan flow rate.

According to a preferred embodiment of the present invention, the control unit 172 is configured to increase the flow rate of the compressor unit 140 when the weighted average A of the first difference D(1)=Ts(1)−Tt(1) and the second difference D(2)=Ts(2)−Tt(2) is higher than zero.

According to a preferred embodiment of the present invention, the control unit 172 is configured to decrease the flow rate of the compressor unit 140 when the weighted average A of the first difference D(1)=Ts(1)−Tt(1) and the second difference D(2)=Ts(2)−Tt(2) is lower than zero.

Like in the embodiment of the invention illustrated in FIG. 1, the control unit 172 is preferably configured to increase the flow rate of the first fan 180(1) when the first difference D(1)=Ts(1)−Tt(1) is higher than zero.

Like in the embodiment of the invention illustrated in FIG. 1, the control unit 172 is preferably configured to decrease the flow rate of the first fan 180(1) when the first difference D(1)=Ts(1)−Tt(1) is lower than zero.

Naturally, the concepts of the present invention described in relation to FIG. 2 can be directly applied also to the (not illustrated) case in which only the second evaporator unit 170(2) is associated with a corresponding fan 180(2).

It has to be appreciated that the concepts of the present invention directly apply also to the case in which the flow rate of the compressor unit 140 of the refrigerating appliance 100' illustrated in FIG. 2—which comprises a single fan (in the first storage compartment 110(1))—is set according to a not-weighted average A of D(1) and D(2), such as for example according to an average A that corresponds to the arithmetic mean of D(1) and D(2), like in the embodiment of the invention illustrated in FIG. 1 in which two fans are provided.

Moreover, the concepts of the present invention described with reference to FIG. 2 can be also applied to the case illustrated in FIG. 1—which comprises two fans —, so that also the flow rate of the compressor unit 140 of the refrigerating appliance 100 can be set according to a weighted average of D(1) and D(2).

FIG. 3 illustrates a flow chart 300 of the main operations carried out by the control unit 172 according to embodiments of the present invention during the operation of the refrigerating appliance.

According to a preferred embodiment of the present invention, the control unit 172 collects from the first temperature sensor 175(1) a first sensed temperature Ts(1) value indicative of the actual temperature inside the first storage compartment 110(1), and collects from the second temperature sensor 175(2) a second sensed temperature Ts(2) value indicative of the actual temperature inside the second storage compartment 110(2) (block 310).

Then, according to a preferred embodiment of the present invention, the control unit 172 calculates a first difference D(1)=Ts(1)−Tt(1) between the first sensed temperature Ts(1) and a first target temperature Tt(1) (for example received through the user interface 174), calculates a second difference D(2)=Ts(2)−Tt(2) between the second sensed temperature Ts(2) and a second target temperature Tt(2) (for example received through the user interface 174), calculates an average A of D(1) and D(2) (for example, the average A may correspond to (D(1)+D(2))/2 in the case of the embodiment illustrated in FIG. 1 or to (W(1)D(1)+W(2)D(2))/(W(1)+W(2)), W(1)>W(2) in the case of the embodiment illustrated in FIG. 2), and accordingly sets a flow rate of the compressor unit 140 according to said average A (block 320).

At this point, according to a preferred embodiment of the present invention, the control unit 172 sets the flow rate of the first fan 180(1) according to the first difference D(1)=Ts(1)−Tt(1) (block 330).

Then, if the second fan 180(2) is present, according to a preferred embodiment of the present invention, the control unit 172 sets the flow rate of the second fan 180(2) according to the second difference D(2)=Ts(2)−Tt(2) (block 340).

At this point, the flow chart returns to block 310, for collecting new first and second sensed temperature Ts(1), Ts(2) values and repeating the operations of blocks 320, 330 and (if possible) 340 using the new sensed temperature Ts(1), Ts(2) values.

Naturally, in order to satisfy local and specific requirements, a person skilled in the art may apply to the invention described above many logical and/or physical modifications and alterations. More specifically, although the invention has been described with a certain degree of particularity with reference to preferred embodiments thereof, it should be understood that various omissions, substitutions and changes in the form and details as well as other embodiments are possible. In particular, different embodiments of the invention may even be practiced without the specific details (such as the numeric examples) set forth in the preceding description for providing a more thorough understanding thereof; on the contrary, well known features may have been omitted or simplified in order not to obscure the description with unnecessary particulars.

For example, although in the embodiments of the invention herein described the refrigerating appliance comprises two storage compartments, the concepts of the present invention can be directly applied in case more than two storage compartments are provided.

Moreover, similar considerations apply in case the refrigeration circuit is provided with more than one condenser unit.

The invention claimed is:

1. A refrigerating appliance comprising:

a first storage compartment and a second storage compartment, the first and second storage compartments being separated from each other;

a refrigeration circuit comprising a first evaporator associated to the first storage compartment, a second evaporator associated to the second storage compartment, a condenser, an expansion valve, and a compressor for causing refrigerant to flow in the refrigeration circuit in sequence through the condenser, the expansion valve, the first evaporator, and then directly to the second evaporator, before reaching again the compressor, wherein the first evaporator, the second evaporator and the compressor are fluidly connected in series;

temperature sensors adapted to sense a first temperature indicative of the temperature inside the first storage compartment and a second temperature indicative of the temperature inside the second storage compartment;

a control unit configured to set a flow rate of the compressor according to both:

a first difference between the sensed first temperature and a first storage compartment target temperature, and a second difference between the sensed second temperature and a second storage compartment target temperature, wherein at least one evaporator between the first evaporator and the second evaporator is associated with a corresponding fan configured to promote heat exchange between said at least one evaporator and the storage compartment associated to said at least one evaporator, wherein the control unit is further configured to set a flow rate of the corresponding fan according to a difference between:

said sensed temperature of the storage compartment associated with the evaporator which is in turn associated with the corresponding fan, and said target temperature of said storage compartment associated with the evaporator which is in turn associated with the corresponding fan, wherein the control unit is further configured to:

when the first difference is higher than zero, increase the flow rate of a corresponding first fan;

when the first difference is lower than zero, decrease the flow rate of the corresponding first fan, and/or:

when the second difference is higher than zero, increase the flow rate of a corresponding second fan, and when the second difference is lower than zero, decrease the flow rate of the corresponding second fan.

2. The refrigerating appliance of claim 1, wherein the control unit is configured to set the flow rate of the compressor according to an average of said first difference and said second difference.

3. The refrigerating appliance of claim 2, wherein the control unit is configured to:

when the average of said first difference and said second difference is higher than zero, increase the flow rate of the compressor, and when the average of said first difference and said second difference is lower than zero, decrease the flow rate of the compressor.

4. The refrigerating appliance of claim 1, wherein:

the first evaporator is associated with the corresponding first fan configured to promote heat exchange between said first evaporator and the first storage compartment, and the second evaporator is associated with the corresponding second fan configured to promote heat exchange between said second evaporator and the second storage compartment, wherein:

the control unit is configured to set a flow rate of the corresponding first fan according to said first difference, and the control unit is configured to set a flow rate of the corresponding second fan according to said second difference.

5. The refrigerating appliance of claim 1, wherein:

the first evaporator is associated with a corresponding first fan configured to promote heat exchange between said first evaporator and the first storage compartment, and no fan is associated with the second evaporator, wherein:

the control unit is configured to set the flow rate of the compressor according to a weighted average of said first difference and said second difference, with said first difference that has a lower weight compared to a weight of said second difference.

6. The refrigerating appliance of claim 5, wherein the control unit is configured to set a flow rate of said first fan according to said first difference.

7. The refrigerating appliance of claim 5, wherein the control unit is configured to:

when the weighted average of said first difference and said second difference is higher than zero, increase the flow rate of the compressor, and when the weighted average of said first difference and said second difference is lower than zero, decrease the flow rate of the compressor.

8. The refrigerating appliance of claim 5, wherein the control unit is configured to:

when the first difference is higher than zero, increase the flow rate of the first fan;

when the first difference is lower than zero, decrease the flow rate of the first fan.

9. The refrigerating appliance of claim 1, wherein the refrigeration circuit is arranged to have the first evaporator upstream the second evaporator along a flow direction of the refrigerant in said refrigeration circuit.

10. The refrigerating appliance of claim 1, wherein the compressor is a variable speed compressor, the control unit being configured to set the flow rate of the compressor by setting the speed of the compressor.

11. The refrigerating appliance of claim 1, wherein the control unit is configured to set the flow rate of the compressor by setting a duty cycle of the compressor.

12. A method for operating a refrigerating appliance comprising:

a first storage compartment and a second storage compartment, the first and second storage compartments being separated from each other;

a refrigeration circuit comprising a first evaporator associated to the first storage compartment, a second evaporator associated to the second storage compartment, a condenser, an expansion valve, and a compressor for causing refrigerant to flow in the refrigeration circuit in sequence through the condenser, the expansion valve, the first evaporator, and then directly to the second evaporator, before again reaching the compressor, wherein the first evaporator, the second evaporator and the compressor are fluidly connected in series, the method comprising;

sensing a first temperature indicative of the temperature inside the first storage compartment and a second temperature indicative of the temperature inside the second storage compartment;

setting a flow rate of the compressor according to both:

a first difference between the sensed first temperature and a first storage compartment target temperature, and a second difference between the sensed second temperature and a second storage compartment target temperature, wherein at least one evaporator between the first evaporator and the second evaporator is associated with a corresponding fan configured to promote heat exchange between said at least one evaporator and the storage compartment associated to said at least one evaporator, wherein a control unit is configured to set a flow rate of the corresponding fan according to a difference between:

said sensed temperature of the storage compartment associated with the evaporator which is in turn associated with the corresponding fan, and said target temperature of said storage compartment associated with the evaporator which is in turn associated with the corresponding fan, wherein the control unit is further configured to:

when the first difference is higher than zero, increase the flow rate of a corresponding first fan;

when the first difference is lower than zero, decrease the flow rate of the corresponding first fan, and/or:

when the second difference is higher than zero, increase the flow rate of a corresponding second fan, and when the second difference is lower than zero, decrease the flow rate of the corresponding second fan.

* * * * *